United States Patent [19]

Otake

[11] 4,234,079

[45] Nov. 18, 1980

[54] PACKAGING FOR TOY ARTICLES AND THE LIKE

[75] Inventor: Michiko Otake, Ichikawa, Japan

[73] Assignee: Takara Co., Ltd., Tokyo, Japan

[21] Appl. No.: 51,004

[22] Filed: Jun. 22, 1979

[51] Int. Cl.[3] ..... B65D 25/00

[52] U.S. Cl. ..... 206/45.34; 206/459

[58] Field of Search ..... 206/459, 45.31, 45.33, 206/45.34, 278, 299

[56] References Cited

U.S. PATENT DOCUMENTS

| | | | |
|---|---|---|---|
| 2,033,998 | 3/1936 | Prager | 206/459 |
| 3,172,531 | 3/1965 | Shillman | 206/45.34 |
| 3,190,440 | 6/1965 | Palmer | 206/45.31 |
| 3,389,850 | 6/1968 | Rockefeller | 229/16 |
| 3,494,322 | 2/1970 | Dubbels | 206/459 |
| 3,739,740 | 6/1973 | Fromer | 206/459 |

*Primary Examiner*—Joseph Man-Fu Moy

*Attorney, Agent, or Firm*—Jackson, Jones & Price

[57] ABSTRACT

A package designed for containing and exhibiting toy articles and the like is disclosed. The package includes a packing member having an enclosure wherein the toy articles are contained. A portion of the packing member is transparent so that the toy articles may be viewed. A display member having a plurality of illustrations or pictures depicting the toy articles is operatively attached to the packing member in such a manner that a substantial portion of the display member is concealed from view. The display member is selectively positionable relative to an aperture or transparent member which is provided in the package. One of the illustrations may be viewed through the aperture or transparent member by a player. By manually positioning the display member relative to the aperture or transparent member the player may select any one of the illustrations or pictures for viewing.

2 Claims, 6 Drawing Figures

FIG. 1
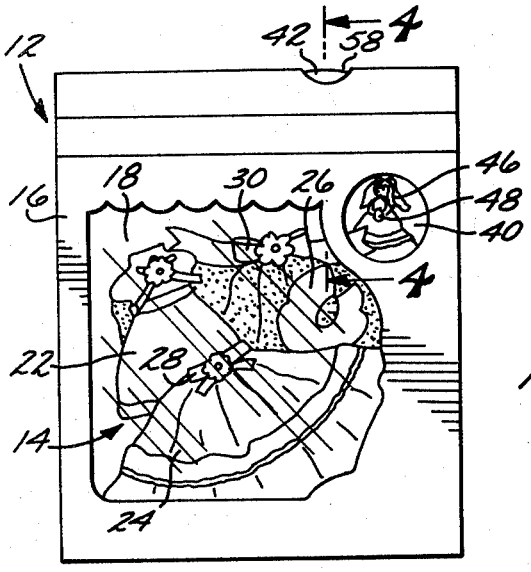
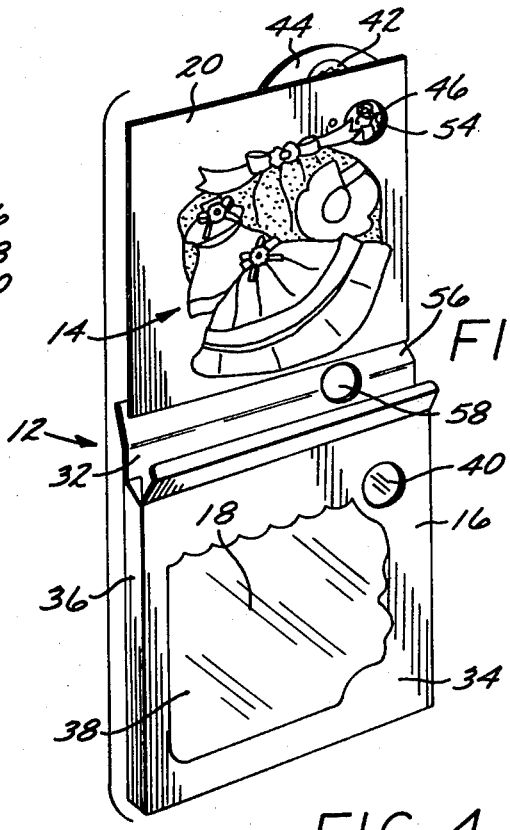
FIG. 2
FIG. 3
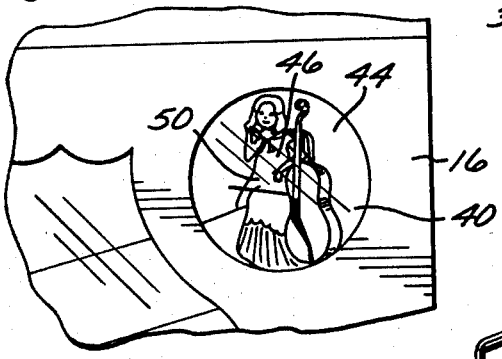
FIG. 4
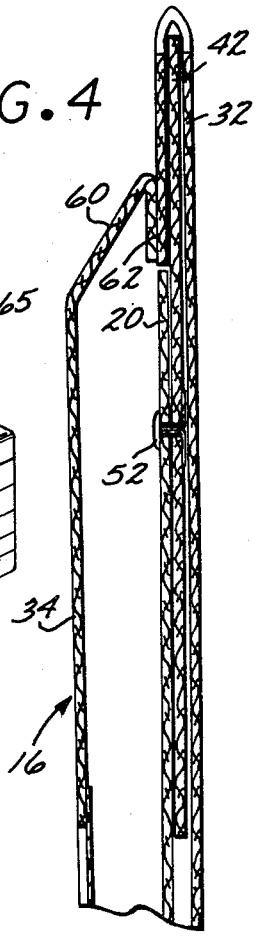
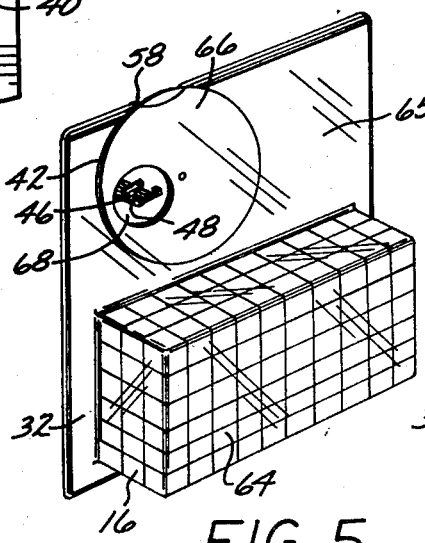
FIG. 5
FIG. 6
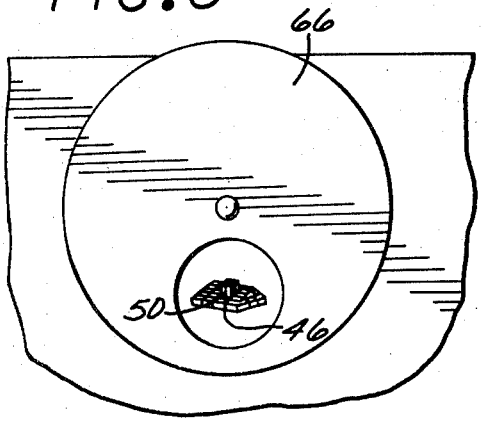

PACKAGING FOR TOY ARTICLES AND THE LIKE

BACKGROUND OF THE INVENTION

1. Field of the Invention

The present invention relates to packaging for toy articles and the like, and particularly to a packaging for toy doll dress pieces which is provided with a display device for selectively displaying a plurality of illustrations or pictures of the dress pieces in different arrays.

2. Brief Description of the Prior Art

The prior art has provided a large variety of packaging designs for toy articles and the like. In addition, the toy industry is well aware of toy articles wherein a rotatably mounted partially concealed display member bears a plurality of illustrations or pictures. A cut-away portion or aperture is provided in a member covering the display member and a player may select one of the illustrations or pictures for viewing by aligning the same with the aperture provided in the covering member.

The packaging industry is still seeking to provide novel and versatile packaging for toy articles. Accordingly, there is a need in the prior art for the novel packaging of the present invention.

SUMMARY OF THE INVENTION

It is an object of the present invention to provide a decorative package for toy articles and the like and particularly for toy doll dress pieces.

It is another object of the present invention to provide a decorative package for a toy article and the like wherein a player may select for viewing one of a pluarlity of illustrations or pictures depicting the toy article.

It is still another object of the present invention to provide a decorative package for a toy article and the like wherein the viewer may view the toy article together with one of the selected illustrations or pictures.

These and other objects and advantages are attained by a package which includes a packing member having an enclosure wherein a toy article or the like is placed. A display member which has a plurality of illustrations or pictures affixed thereto is movably attached to the packing member. The display member is positioned relative to the package in such a manner that a substantial portion of the display member is concealed from view. The display member is selectively positionable relative to an aperture or a transparent member which is provided in the package. The aperture or transparent portion allows visual access to only one illustration or picture at any given time. By positioning the display member relative to the aperture or transparent member a viewer may, at his option, select any one of the pictures for viewing. An additional transparent member may be provided in the package member for allowing visual access to the article itself.

The objects and features of the present invention are set forth in the appended claims. The present invention may be best understood by reference to the following description, taken in connection with the accompanying drawings in which like numerals indicate like parts.

BRIEF DESCRIPTION OF THE DRAWINGS

FIG. 1 is a top plan view of a first specific embodiment of a combination package and toy doll dress of the present invention, the view showing a first optionally selected picture of the doll dress;

FIG. 2 is a partially exploded perspective view of the first specific embodiment of the combination package and toy doll dress of the present invention;

FIG. 3 is a partial plan view of the first specific embodiment of the combination package and toy doll dress of the present invention, the view showing a second optionally selected picture of the doll dress;

FIG. 4 is a partial cross sectional view of the first specific embodiment of the combination package and toy doll dress of the present invention, the cross section being taken at lines 4—4 of FIG. 1;

FIG. 5 is a perspective view of a second specific embodiment of the present invention comprising a combination package and building blocks in accordance with the present invention, the view showing a first optionally selected picture of the building blocks, and FIG. 6 is a partial plan view of the second specific embodiment of the present invention, the view showing a second selected picture of the building blocks.

DESCRIPTION OF THE PREFERRED EMBODIMENTS

The following specification taken in conjunction with the drawings sets forth the preferred embodiments of the present invention in such a manner that any person skilled in the packaging and toy manufacturing arts can use the invention. The embodiments of the invention disclosed herein are the best modes contemplated by the inventor for carrying out his invention in a commercial environment although it should be understood that various modifications can be accomplished within the parameters of the present invention.

Referring to the drawing figures and particularly to FIGS. 1, 2 and 3 a first specific embodiment of a combination of package 12 and toy doll dress pieces 14 is disclosed. The package 12 includes a packing member 16 which is manufactured from cardboard or like material. The packing member 16 is a substantially box shaped member of substantially greater width and height than thickness whereby the packing member 16 has a substantially flat appearance.

The box shaped packing member 16 includes an enclosure 18 wherein a support member or support panel 20 together with the doll dress pieces 14 are placed. The doll dress pieces 14 are manufactured according to standard practice in the toy manufacturing arts and therefore need not be disclosed here in detail. It is sufficient to state for the purpose of understanding the present invention that the doll dress pieces 14 may comprise a plurality of toy cloth or paper articles. The doll dress pieces 14 shown on FIGS. 1 and 2 include a dress 22, a lace skirt 24, a collar 26, a belt 28 and a headdress 30. It should be expressly understood that various other combination of toy cloth pieces as well as various other toy articles may be provided in accordance with the present invention. The doll dress pieces 14 may be glued, stapled, or otherwise fastened to the support member or panel 20. In this specific embodiment, the doll dress pieces 14 are attached to the support panel 20 by a plurality of thin strings (not shown) which may be easily removed by a child.

The support member or panel 20 is a rectangular panel member which is configured for containment within the enclosure 18 of the packing member 16. The packing member 16 has a lower or base panel member 32 and an upper panel member 34. The lower and upper panel members 32 and 34 are attached to one another, in accordance with standard practice in the packaging industry, through side panel members 36. One of the side panel members 36 is shown in FIG. 2. The upper panel member 34 which is constructed from nontransparent cardboard material includes a first transparent portion 38. The first transparent portion 38 is configured for allowing full visual access to the doll dress 14 when the latter is contained within the packing member 16. The first transparent portion 38 may be manufactured from cellophane or other relatively inexpensive transparent plastic material and is glued to the cardboard upper panel member 34.

The upper panel member 34 additionally includes a second transparent portion 40 which, similarly to the first transparent portion 38, is made of transparent plastic material. The second transparent portion 40, shown on FIGS. 1–3, is of a circular configuration. The purpose and function of the second transparent portion 40 will be best understood as the present invention is further described below.

Still referring to FIGS. 1, 2 and 3 and particularly to the cross sectional view of FIG. 4, a display member 42 is disclosed. The display member 42 is a circular or disk shaped member which may be made of cardboard or like material. An upper surface 44 of the display member 42 has a plurality of illustrations or pictures permanently affixed thereto. Each illustration or picture 46 in the herein described first specific embodiment, is a picture of a toy doll wearing a different combination of the toy doll dress pieces 14 contained in the package 12. Thus, by way of specific example, a first illustration or picture 48, shown on FIG. 1, shows the toy doll wearing the dress member 22, lace skirt 24 and the headdress 30. A second illustration or picture 50, shown in FIG. 3, shows the toy doll wearing the dress member 22, lace skirt 24 and the collar 26. In the herein described first specific embodiment four different illustrations or pictures 46 are affixed to the upper surface 44 of the display member 42, although it should be expressly understood that a different number of pictures 46 may be provided.

Referring now specifically to FIGS. 2 and 4, mounting of the display member 42 to the support member 20 and placement of the support member 20 within the packing member 16 is disclosed. It is a stated objective of the present invention to provide a package wherein a player or viewer may select any one of the illustrations or pictures 46 for viewing. In accordance with this objective, the display member 42 is rotatably mounted below the support member 20 with a pin 52 acting as an axle of rotation.

A circular aperture 54 is provided in the support member 20 in such a manner than any one of the illustrations or pictures 46 may be aligned with the aperture 54 by rotation of the display member 42. When one of the illustrations or pictures 46 is aligned with the circular aperture 54 and the support member 20 is properly placed within the enclosure 18 of the packing member 16, the illustration or picture 46 is also aligned with the second transparent portion 40 of the upper panel member 34.

In order to effectively contain the support member 20 together with the toy doll dress pieces 14 within the packing member 16, a flap portion 56 is provided on the lower or base panel member 32. The flap portion 56 folds over the support member 20 as is shown on FIG. 4, thereby effectively holding the support member 20. An arcuate cut-away portion 58, best shown on FIGS. 1 and 2 is provided in the area wherein the flap 56 abuts the lower or base panel member 32. The circular display member 42 protrudes through the cut-away portion 58 so that the display member 42 is accessible for manual rotation.

In order to complete the containment of the support member 20 together with the toy doll dress pieces 14 in the package 12, the upper panel member 34 is provided with first and second ear members respectively bearing the reference numerals 60 and 62. The first ear member 60, as is best shown on FIG. 4, is angularly disposed relative to the upper panel member 34. The second ear member 62 is angularly disposed relative to the first ear member 60 and is folded to lie flatly upon the flap portion 56. The second ear member 62 may be lightly glued to the flap portion 56 thereby sealing the package 12.

It should be readily apparent from the above description that the novel combination package 12 and toy doll dress pieces 14 of the present invention provide several advantages. These advantages include the ability to view the toy doll dress pieces 14 while they are still in the package 12. In addition, a viewer or potential purchaser has ready access to the rotatable display member 42 without actually opening the package 12. Thus the viewer may rotate the display member 42 for aligning the several illustrations or pictures 46 with the circular aperture 54 and with the second transparent portion 40 thereby bringing the several illustrations or pictures 46 into view.

It should be expressly understood that the generic principles disclosed herein are readily applicable for the design of packaging for articles other than the hereinbefore specifically described toy doll dress pieces 14. FIGS. 5 and 6 schematically illustrate a second specific embodiment of the present invention wherein a combination of toy building blocks 64 and the novel package of the present invention is schematically illustrated. A substantially box shaped packing member 16 contains an enclosure wherein the plurality of building blocks 64 are contained. A top portion 65 of the packing member is made of transparent material. The building blocks 64 are schematically illustrated as square blocks on FIG. 5. A base panel member 32 which includes the display member 42 has a plurality of illustrations or pictures 46 affixed thereto. Each illustration or pcture 46 e.g. depicts a different toy object which may be constructed from the building blocks 64. A first illustration or picture 58 is shown on FIG. 5 and a second illustration or picture 50 is shown on FIG. 6. A substantially circularly shaped member 66 which has a circular aperture 68 is rotatably mounted upon the display member 42. A cut-away portion 58 located in the packing member 16 provides manual access to the circular member 66. The circular member 66 conceals all but one illustration or picture 46 on the display member 42. As the circular member 66 is manually rotated by a viewer, different illustrations or pictures 46 come into view through the circular aperture 68.

As an alternative to the hereinbefore disclosed specific embodiments of the present invention, the circular rotatable member 66 of the second specific embodiment may be provided with a transparent member (not shown) in place of the circular aperture 68. The transparent member (not shown) may have an illustration or picture (not shown) which is then viewed superimposed upon the several illustrations or pictures 46 provided on the display member 42. For example, the pictures (not shown) on the transparent member (not shown) may comprise pictures of several doll dress pieces and the illustrations or pictures 46 on the display member 42 may comprise pictures of a toy doll. As the transparent member bearing a picture of the doll cloth pieces is superimposed over a given picture 46 of the display member, the doll (not shown) is viewed wearing the doll cloth pieces.

Various further modifications of the package and article combination described above may become readily apparent to those skilled in the art in light of the hereinbefore disclosed teachings. Accordingly, the scope of the present invention should be interpreted solely from the following claims.

What is claimed is:

1. In combination a toy doll dress and a package for the toy doll dress, the package comprising:

a substantially flat support member to which the doll dress is fastened;

a packing member having an enclosure adapted to receive the support member and the doll dress, the packing member having a top panel including a transparent member for viewing the doll dress;

a display member rotatably mounted to the support member, the display member having a plurality of illustrations of a doll wearing the doll dress, and means for selectively exposing to view only a single illustration selected by a viewer at his option, the means including an aperture incorporated in the support member and a cut-away portion of the packing member, the display member being accessible in the cut-away portion for manipulation by a viewer, and the aperture being configured to expose for view only a single selected illustration.

2. The invention of claim 1 wherein the top panel of the packing member includes a second transparent member disposed above the aperture.

* * * * *